United States Patent [19]

Branton

[11] 3,970,456

[45] July 20, 1976

[54] METHOD FOR PREPARING A VIEWING-SCREEN STRUCTURE FOR A CRT HAVING TEMPERATURE-COMPENSATED MASK-MOUNTING MEANS, INCLUDING COOLING MASK DURING EXPOSURE

[75] Inventor: Tom Wendell Branton, Lancaster, Pa.

[73] Assignee: RCA Corporation, New York, N.Y.

[22] Filed: Dec. 6, 1974

[21] Appl. No.: 530,404

[52] U.S. Cl. ..... 96/36.1; 354/1

[51] Int. Cl.[2] ..... G03C 5/00

[58] Field of Search ..... 96/36.1; 313/405, 406, 313/284, 286, 292; 354/1

[56] References Cited

UNITED STATES PATENTS

| | | | |
|---|---|---|---|
| 3,330,980 | 7/1967 | Shrader | 313/405 |
| 3,399,919 | 8/1968 | Schwartz et al. | 313/405 |
| 3,524,974 | 8/1970 | Kautz | 313/405 |
| 3,621,318 | 11/1971 | Lewinson | 313/405 |
| 3,700,949 | 10/1972 | Watanabe et al. | 313/405 |
| 3,803,436 | 4/1974 | Morrell | 313/405 |
| 3,823,336 | 7/1974 | Nakamura et al. | 313/405 |
| 3,873,875 | 3/1975 | Miller | 313/405 |

*Primary Examiner*—Edward C. Kimlin

*Attorney, Agent, or Firm*—G. H. Bruestle; L. Greenspan

[57] ABSTRACT

In a direct photographic process for preparing a viewing-screen structure for a shadow-mask-type CRT having temperature-compensated mask-mounting means, an inner surface of the panel is coated with a layer of light-hardenable material and then heated above 50°C to dry the layer. While the panel is above 40°C, the layer is exposed to actinic light through the mask of the tube. The temperature-compensating-mounting means for the mask is cooled, as with streams of air, to adjust the spacing between the mask and the inner surface of the panel and to prevent the mask from being twisted on the mounting means. Also the mask may be cooled to prevent doming of the mask.

7 Claims, 2 Drawing Figures

METHOD FOR PREPARING A VIEWING-SCREEN STRUCTURE FOR A CRT HAVING TEMPERATURE-COMPENSATED MASK-MOUNTING MEANS, INCLUDING COOLING MASK DURING EXPOSURE

BACKGROUND AND SUMMARY OF THE INVENTION

This invention relates to an improved direct photographic process for preparing a screen structure for a shadow-mask-type cathode-ray tube.

Direct photographic processes for preparing a screen structure for a shadow-mask-type cathode-ray tube have been described previously, for example, in U.S. Pat. Nos. 3,406,068 to H. B. Law and 3,685,994 to H. R. Frey. The tube is usually comprised of a faceplate panel which includes a viewing window and peripheral sidewalls extending from the margins of the window. A mask assembly comprising an apertured mask and temperature-compensating mounting means is mounted in the panel, usually on three or four studs implanted in the panel sidewalls, with the mask spaced a desired distance from the inner surface of the window. Temperature-compensating mounting means for the mask have been described previously, for example, in U.S. Pat. Nos. 3.803,436 to A. M. Morrell and 3,330,980 to T. M. Shrader. The temperature-compensating feature of the mounting means operates to move the mask towards the screen as the tube heats up (to a maximum of about 80°C) during the operation of the tube, so that a projection of electrons through each aperture remains on its associated screen element. Heating causes the mask assembly to expand, moving the off-center apertures outwards from the longitudinal axis of the tube. By moving the mask forward towards the screen, the projection from the off-center apertures upon the screen is moved inward towards the tube axis, thereby compensating for the outward movement caused by heating.

In one method for making a screen structure for a cathode-ray tube having a shadow mask mounted on temperature-compensating mask-mounting means in a faceplate panel, the panel is coated with a layer comprising a light-hardenable material, (with or without phosphor particles), the panel and layer are heated to dry the layer, and the mask is mounted in the panel. Then, actinic light is projected through the mask from a small-area source to expose selected areas of the dry layer to the light so as to harden (insolubilize) the exposed portions of the layer. The exposing step is assumed to take place with all parts of the system at about 22°C. In many situations, the panel is still hot (above 40°C) just prior to and during the exposing step. Heat from the panel warms the temperature-compensating mask-mounting means and causes the mask to move forward towards the layer. This produces off-center exposed areas that are located inwards, resulting in misplaced light-hardened areas, which may later be misregistered with respect to the electron beams impinging on the screen. In some cases, because of the geometry of the mounting means, as with some three-spring structures, the mask assembly is rotated or twisted, as well as screen elements being shifted. Also, a hot panel may cause the mask to dome or become distorted when the mask becomes warm faster than the frame to which it is attached.

The novel method is similar to the prior method except that, after the mask assembly is mounted in the panel, and while the panel is still above 40°C, the temperature-compensating mounting means is cooled to provide a desired spacing between the mask and the panel. The cooling is conducted during the period of the light exposure, and may be commenced before or after the start of the exposure. One convenient method for cooling the mounting means is to pass a stream of air over the mounting means during the exposure. Preferably, the mounting means is cooled with room-temperature air to temperatures below 25°C as desired. Practice of the invention can be used to avoid shifting of screen elements and/or twisting of the mask assembly resulting from the use of a hot panel during the light-exposing step. Additional benefits in dimensional stability of the mask may be achieved in some cases by also cooling the mask itself, as with one or more streams of cooling air. Cooling of the mask can be used to reduce or eliminate doming or anti-doming movements of the mask which may later cause misregister of the electron beams on the elements of the viewing screen.

DESCRIPTION OF THE PREFERRED EMBODIMENT

Figure 1:
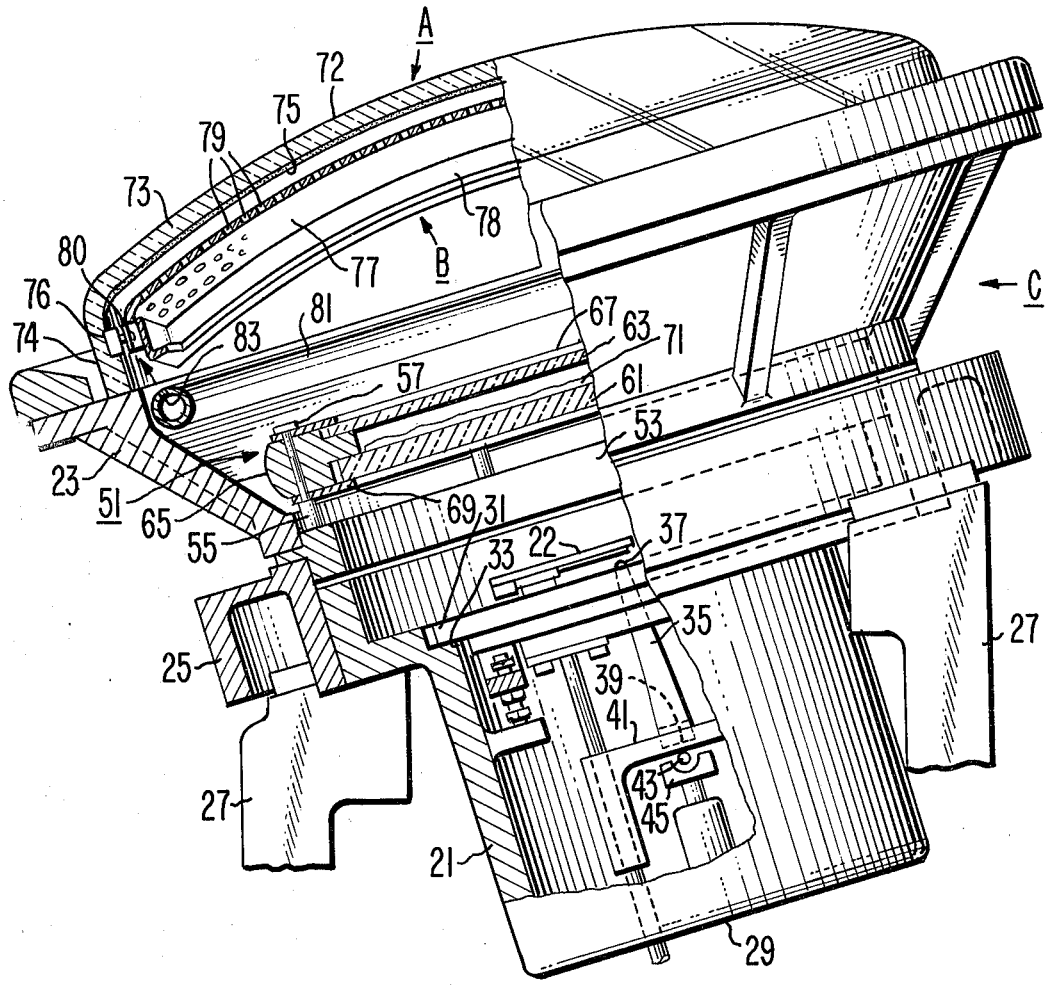
FIG. 1 is a partially-broken-away elevational view of a lighthouse on which the exposure steps of the novel method may be practiced. The lighthouse has a faceplate-panel assembly thereon in position for exposure.

As an example of the novel method, the invention is applied to printing the phosphor elements for a screen for a 17-inch 90°-deflection shadow-mask-type cathode-ray tube for a television receiver. Since shadow-mask-type cathode-ray tubes are described in the prior art, they need not be described in detail here. Generally, however, the tube is comprised of an evacuated glass envelope including an electrongun-mount assembly, a funnel assembly, and a faceplate-panel assembly.

In manufacturing the tube, the faceplate-panel assembly is completed as a unit. The panel assembly A shown in FIG. 1 comprises a glass faceplate panel 72 and an apertured-mask assembly B mounted in the panel 72. The panel 72 includes a viewing window 73 and sidewalls 74. Mounting studs 76 are implanted in spaced positions around the inside sidewalls 74. The mask assembly B includes a mask 77 having an array of apertures 79 therein. The mask 77 is attached along the margins thereof to a mask frame 78 which has mounting means 80 attached thereto at three spaced positions. Each mounting means 80 includes a bimetal portion and a spring portion. The extended ends of the mounting means 80 are adapted to fit on the studs 76 in a predetermined relationship. The bimetal portion is adapted to adjust the spacing of the mask 77 with respect to the inner surface of the viewing window 73 with changes in temperature of the mask assembly B.

The panel assembly A includes a light-hardenable layer 75 on the inner surface of the window 73. In this example, the light-hardenable layer 75 includes particles of a green-emitting phosphor, polyvinyl alcohol, and a dichromate photosensitizer for the alcohol.

The lighthouse C illustrated in FIG. 1 is comprised of a light box 21 and a panel support 23 held in position by bolts (not shown) with respect to one another on a base 25 which in turn is supported at the desired angle by lugs 27. The light box is a cylindrical cup-shaped casting closed at one end by an integral end wall 29. The other end of the light box is closed by a plate 31 which fits in a circular recess 33 in the light box 21. The plate 31 has a central hole therein through which the light pipe 35 (referred to as a collimator in the tube-making art) in the form of a tapered glass rod extends. The narrow end 37 of the light pipe 35 extends slightly above the plate 31 and constitutes the small area light source of the lighthouse. The wider end 39 of the light pipe 35 is held in position by a bracket 41 opposite an ultraviolet lamp 43 within the light box 21. A light reflector 45 is positioned behind the lamp 43.

The lens assembly 51 is mounted on a lens-assembly support ring 53 and standoff spacers 55 with bolts 57. The support ring 53 is clamped in position between the light box 21 and the panel support 23. The lens assembly 51 is comprised of a correction lens 61 and a wedge lens 63 held and spaced from each other by separator ring 65, an upper clamp 67 and a lower clamp 69. The upper surface of the wedge lens has thereon a light intensity correction filter 71 which has a neutral gray transmittance that varies from point to point, so that point-to-point variations in brightness in the light field are reduced according to a prescribed plot. An eclipser 22 normally blocks the upward path of the light emitted from the end 37 of the light pipe 35, but can be swung out of the light path when it is desired to expose the coating 75 on the window 73.

A length of ¼-inch plastic tubing 81 extends around the inside wall of the panel support 23. Both ends of the tubing terminate in two legs of a metal "T" fitting (not shown) near the higher side of the panel support 23, which is tilted. The third leg of the T fitting is connected to a source of compressed air. Air may be supplied continuously, or may be supplied only when the eclipser 22 is swung away from the light pipe 35, or may be supplied according to some other program. The tubing 81 has a hole 83 opposite the position of each bimetal portion of the mask-mounting means 80, so that a stream of cooling air (shown by the arrow) can be passed thereover as desired.

To practice the invention, on the lighthouse C shown in FIG. 1, the inner surface of the window 73 is coated with a layer 75 of light-hardenable material; for example, a layer of slurry comprising water, green-emitting phosphor particles, polyvinyl alcohol and ammonium dichromate. The panel 72 and a layer 75 are heated above 50°C to dry the layer 75. Such temperatures can be as high as 80°C. Then, after drying, but while the panel 72 is above 40°C, usually at about 45° to 50°C, the mask assembly B, which is at room temperature, is inserted in the panel 72 with the mounting means 80 on the studs 74. Upon insertion, the temperatures of the mounting means 80 rise to above 40°C due to the radiation of heat from the relatively larger mass of the panel 72 and particularly the sidewalls 74. The mask 77 and the mask frame 78 also rise in temperature due to radiation of heat from the panel 72. A rise in temperature of the mounting means 80 causes the mask to move towards the window 73.

The panel 72 with the mask assembly B mounted therein is placed on the panel support 23 of the lighthouse C as shown in FIG. 1. The eclipser 22 is swung out of the light path permitting light from the source 37 to pass upward through the lens assembly 51, then through the apertures 79 of the mask 77 incident upon the layer 75. When the eclipser 22 is swung out of the light path, compressed air at room temperature is fed into the tubing 81 and out through the holes 83, producing streams of cooling air which pass over the mounting means 80. The cooling air has the effect of reducing the temperature of the mounting means 80 below 25°C, although the mask 77 and a mask frame 78 may be at higher temperatures. Cooling the mounting means 80 causes the mask 77 to move away from the window 73.

Figure 2:
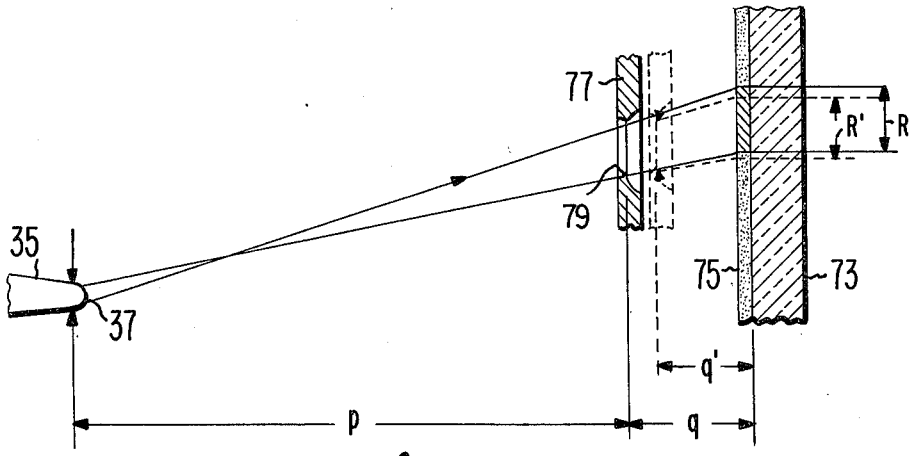
FIG. 2 is a schematic diagram illustrating a lighthouse geometry and some thermally-induced movements in the panel assembly.

FIG. 2 shows schematically light rays from the narrow end of the light pipe 35 passing through an off-center mask aperture 79 of the mask 77 incident upon the layer 75, whereby the region R is insolubilized by the light. The mask 77 is spaced a distance q from the inner surface of the window 73. If no cooling air were employed, the mounting means, being temperature-compensating and being at a much higher temperature than 25°C, would maintain the mask 77 closer to the window 73, as shown by the distance q′. The effect of the different mask position is to insolubilize a region R′, which is displaced laterally inwardly along the layer 75. When the tube is later completed, the screen element R′ would not then be properly located with respect to the mask aperture 79, whereas the screen element R would be properly located.

After the layer 75 has been exposed for a sufficient period of time, light from the light source 37 is eclipsed and the supply of air to the tubing 80 is stopped. Then, the panel assembly A is removed from the lighthouse C, the mask assembly B is removed from the panel 72, and the coating 75 is developed by flushing the layer 75 with an aqueous solvent. Unexposed areas of the layer 75 are flushed away by the solvent, and the exposed areas with the greenemitting-phosphor particles therein are retained in place.

The novel method may then be repeated as described above for making the blue-emitting-phosphor elements by substituting blue-emitting-phosphor particles for the greenemitting-phosphor particles in the layer 75. This latter layer is applied over the green-emitting-phosphor elements. The mask assembly B is again inserted in the faceplate panel 72, and the second layer is exposed on a second lighthouse. The second lighthouse is similar to the first lighthouse C except that it has a different lens assembly and there is a different relative location for the light pipe 35. After exposure on the second lighthouse, the layer with the blue-emitting phosphor therein is developed as described above to remove the unexposed portions of the coating and to retain in place the second exposed portions, which are the blue-emitting-phosphor elements.

The novel method may then be repeated again as described above for making the red-emitting-phosphor elements by substituting red-emitting-phosphor particles for the green-emitting-phosphor particles in the layer 75. This latter layer is applied over the green-emitting- and blue-emitting-phosphor elements that are retained from the prior steps. The mask assembly B is again reinserted in the faceplate panel 72, and the third layer is exposed on a third lighthouse which is similar to the first and second lighthouses except that it has a different lens assembly and the light pipe 35 is located in a different relative position. After exposing the third layer with the red-emitting phosphor therein on the third lighthouse, the third layer is developed as described above to remove the unexposed portions of the layer and to retain in place the exposed portions, which are the red-emitting-phosphor elements.

After the phosphor elements have been printed, the screen structure is filmed, aluminized, and baked out at about 420°C by methods known in the art. The completed screen structure is then assembled, with the mask assembly and other parts, into the faceplate-panel assembly and the panel assembly incorporated into a completed tube.

The novel method may be used with a system employing circular-mask apertures and light sources to yield circular-screen elements as in the example. The novel method may also be used to make line, elliptical, or rectangular screen elements, in which case the geometry of the mask apertures, the light source and the lens assembly may be modified in the manner known in the art.

As was mentioned above, the mask 77 may be heated by the heat radiated from the window 73 above about 40° to 50°C. In the normal case, the mask 77, which has a relatively low mass, heats at a faster rate than does the mask frame 78, which has a relatively greater mass. As a result of this difference in heating rates, the mask frequently will dome due to the different changes in size due to the different heating rates. Doming has the effect of moving portions of the mask towards the window 13. In order to reduce doming of the mask, a jet or a plurality of jets of cooling air; for example, at room temperature, may be played upon the inner surface of the mask 77 to cool the mask below about 25°C. This can be achieved with the tube 81 or with another air-supplied tube adjacent to the tube 81 and having openings adapted to pass air against the mask 77.

It has also been noticed that, because the lighthouse panel support 23 is tilted at an angle from the horizontal plane, heat from the panel 72 tends to concentrate towards the higher side of the panel 72, with the result that the mask 77, the mask frame 78 and the mask-mounting means 80 tend to be heated faster at the higher side than at the lower side. This differential in heating rates between the higher side and the lower side of the panel assembly A may cause distortions, twisting, or localized doming in the mask assembly B. The differential effect can be overcome by introducing cooling air or other cooling means at a greater rate at the higher side of the panel assembly than at the lower side of the assembly. In fact, the cooling pattern may be tailored across the surface of the mask assembly to overcome, locally, the differentials in heating rates across the assembly.

I claim:

1. In a method for preparing a mosaic viewing screen for a cathode-ray tube, said tube comprising a faceplate panel including a viewing window and peripheral sidewalls, a mosaic viewing screen on the inner surface of said window, and a mask assembly including an apertured mask spaced from said window and a temperature-compensating mounting means for mounting said mask assembly in said panel; said method comprising a. coating said inner surface of said window with a layer including a light-hardenable material,
b. heating said panel to temperatures above 50°C to dry said coating,
c. mounting said mask assembly in said heated panel, said mask assembly being at about room temperature,
d. and then, before said panel has cooled below 40°C, exposing said layer to actinic light from a small-area light source projected through said mask;

the improvement comprising, while the temperature of said panel is above 40°C, cooling said mounting means below 40°C to provide a desired spacing between said mask and said inner surface of said window.

2. The method defined in claim 1 wherein said cooling is conducted during said exposing step (d) by passing streams of room-temperature air over said mounting means to cool said mounting means below 40°C.

3. The method defined in claim 1 wherein said mask assembly comprises a metal apertured mask having a peripheral skirt, a peripheral metal frame to which said skirt is attached, and each mounting means includes a bimetal portion attached in spaced positions around said frame.

4. The method defined in claim 3 wherein said mounting means are cooled by blowing streams of room-temperature air over said bimetal portions during said light-exposing step.

5. The method defined in claim 1 wherein, during said exposing step, said panel and mask assembly are tilted at an angle from the horizontal plane, and said cooling is carried out at a faster rate at the higher side of said panel than at the lower side of said panel.

6. The method defined in claim 1 including cooling said mask to reduce doming of said mask.

7. The method defined in claim 1 including passing streams of air over said mask to reduce doming of said mask.

* * * * *